US007922354B2

(12) United States Patent
Everhart

(10) Patent No.: US 7,922,354 B2
(45) Date of Patent: Apr. 12, 2011

(54) SOLID-STATE LIGHTING FIXTURES

(76) Inventor: Robert L. Everhart, Monona, WI (US)

( * ) Notice: Subject to any disclaimer, the term of this patent is extended or adjusted under 35 U.S.C. 154(b) by 296 days.

(21) Appl. No.: 12/191,111

(22) Filed: Aug. 13, 2008

(65) Prior Publication Data

US 2009/0046457 A1 Feb. 19, 2009

Related U.S. Application Data

(60) Provisional application No. 60/955,531, filed on Aug. 13, 2007.

(51) Int. Cl.
*F21V 7/00* (2006.01)

(52) U.S. Cl. ..... 362/235; 362/241; 362/294; 362/373; 362/276; 362/234

(58) Field of Classification Search ..... 362/235, 362/241, 294, 373, 276, 234
See application file for complete search history.

(56) References Cited

U.S. PATENT DOCUMENTS

| | | | | |
|---|---|---|---|---|
| 5,207,504 | A | 5/1993 | Swift et al. | |
| 5,660,461 | A * | 8/1997 | Ignatius et al. | 362/241 |
| 6,076,950 | A | 6/2000 | Topping et al. | |
| 6,078,253 | A | 6/2000 | Fowler | |
| 6,517,218 | B2 | 2/2003 | Hochstein | |
| 6,599,000 | B2 | 7/2003 | Nolan et al. | |
| 6,611,000 | B2 * | 8/2003 | Tamura et al. | 257/80 |
| 6,612,717 | B2 | 9/2003 | Yen | |
| 6,739,734 | B1 | 5/2004 | Hulgan | |
| 6,871,983 | B2 | 3/2005 | Jacob et al. | |
| 6,909,239 | B2 | 6/2005 | Gauna | |
| 6,929,382 | B2 | 8/2005 | Kuisma | |
| 6,952,079 | B2 | 10/2005 | Shiang et al. | |
| 6,979,097 | B2 | 12/2005 | Elam et al. | |
| 7,102,172 | B2 | 9/2006 | Lynch et al. | |
| 7,114,830 | B2 | 10/2006 | Robertson et al. | |
| 7,192,163 | B2 | 3/2007 | Park | |
| 7,217,009 | B2 | 5/2007 | Klose | |
| 7,246,926 | B2 | 7/2007 | Harwood | |
| 7,281,818 | B2 * | 10/2007 | You et al. | 362/241 |
| 2002/0141181 | A1 | 10/2002 | Bailey | |

(Continued)

FOREIGN PATENT DOCUMENTS

JP 2000-207921 A 7/2000

OTHER PUBLICATIONS

International Search Report, Feb. 11, 2009, PCT/US08/073050.

*Primary Examiner* — Stephen F Husar
*Assistant Examiner* — James W Cranson
(74) *Attorney, Agent, or Firm* — Lathrop & Clark LLP

(57) ABSTRACT

A high performance, high efficiency solid state electronic lighting device, having a sealed fixture body for use outdoors or in environments requiring IP rated sealed fixtures, uses light emitting diodes for producing light from AC current that operates on an as needed basis dependent upon occupancy, ambient light levels and facility load requirements. The high performance, high efficiency solid state electronic lighting device can also be used to replace the internal workings and reflective surfaces of a standard fluorescent fixture, a high-intensity-discharge (HID) lamp, or other arc-based lamps using light emitting diodes for producing light from AC current that operates on an as needed basis dependent upon occupancy, ambient light levels and facility load requirements.

18 Claims, 8 Drawing Sheets

U.S. PATENT DOCUMENTS

| | | | |
|---|---|---|---|
| 2003/0048641 | A1 | 3/2003 | Alexanderson et al. |
| 2003/0072157 | A1 | 4/2003 | Nolan et al. |
| 2003/0081419 | A1 | 5/2003 | Jacob et al. |
| 2003/0156416 | A1 | 8/2003 | Stopa et al. |
| 2004/0233672 | A1 | 11/2004 | Dubuc |
| 2005/0047134 | A1 | 3/2005 | Mueller et al. |
| 2005/0237733 | A1 | 10/2005 | Laski et al. |
| 2005/0286265 | A1 | 12/2005 | Zampini et al. |
| 2006/0098438 | A1 | 5/2006 | Ouderkirk et al. |
| 2006/0202850 | A1 | 9/2006 | Hefright et al. |
| 2006/0221606 | A1 | 10/2006 | Dowling |
| 2006/0261741 | A1 | 11/2006 | Hwang |
| 2007/0008167 | A1 | 1/2007 | Parker, Jr. et al. |
| 2007/0064428 | A1 | 3/2007 | Beauchamp |
| 2007/0081339 | A1 | 4/2007 | Chung et al. |
| 2007/0096134 | A1 | 5/2007 | Kim et al. |
| 2007/0103908 | A1 | 5/2007 | Tabito et al. |
| 2007/0165402 | A1 | 7/2007 | Weaver, Jr. et al. |

* cited by examiner

SOLID-STATE LIGHTING FIXTURES

This application claims priority to U.S. Provisional Application Ser. No. 60/955,531, filed Aug. 13, 2007, which is incorporated herein by reference in its entirety.

BACKGROUND

1. Field of the Invention

This invention is directed to lighting fixtures that use solid-state electronic devices as the lighting elements.

2. Related Art

Conventionally, industrial, commercial and, occasionally, residential spaces are illuminated using fluorescent tubes or high-intensity-discharge (HID) lamps. High-intensity discharge (HID) lamps include these types: mercury vapor electrical lamps, metal halide (HQI) electrical lamps, high-pressure sodium (Son) electrical lamps, low-pressure sodium (Sox) electrical lamps and less common, xenon short-arc lamps. The light-producing element of these lamp types is a well-stabilized arc discharge contained within a refractory envelope (arc tube). Whichever metal is used, the lamp produces the light once the metal is heated to a point of evaporation, forming a plasma in the arc tube. Like fluorescent lamps, HID lamps require a ballast to start and maintain their arcs.

However, fluorescent tubes and HID lamps have minimal options for varying light output. Due to their modes of operation, it is difficult and expensive, if not impossible, to moderate the amount of light emitted by a fluorescent tube or an HID lamp. Likewise, due to aging effects and the like, completely turning off and on fluorescent tubes and HID lamps on a need-for-illumination basis is generally discouraged.

SUMMARY OF THE DISCLOSED EMBODIMENTS

Solid-state light emitting electronic elements, such as, for example, light emitting diodes ("LEDs"), have been developed that output intense white light. Such solid-state electronic devices emit light as a function of input current. Thus, the output light intensity can be readily varied by moderating or adjusting the supplied current. Likewise, by turning on and off the supply of current, these solid-state devices can be readily turned on and off with no output delays, such as those present in conventional fluorescent tubes and HID lamps, and without aging the solid-state devices.

This invention provides a light fixture having multiple LED elements in place of conventional light sources such as fluorescent, incandescent or high intensity discharge (HID) lamps.

This invention separately provides a light fixture having multiple LED elements, a gasket, cover and sealing mechanism that seals the light fixture.

This invention separately provides a light fixture having multiple LED elements and a water resistant ingress protection ("IP") rating that allows the light fixture to be used in hostile environments.

This invention separately provides an open light fixture having multiple LED elements that replace a fluorescent strip light including the main fixture body.

This invention separately provides a retrofit kit for a standard fluorescent strip light fixture, allowing the main fixture body to stay intact while the fluorescent bulb is replaced with multiple LED elements.

This invention separately provides a retrofit kit usable to retrofit a 2×4 or a 2×2 fluorescent fixture with a removable pan that houses the LED system.

This invention separately provides a light fixture having multiple LED elements that replace a 2×4 and/or 2×2 fluorescent fixture.

This invention separately provides a light fixture having an ambient light sensor and control system that automatically adjusts a light output of the solid-state light emitting elements based on the sensed ambient light.

This invention separately provides a light fixture having an occupancy light sensor and control system that adjusts a light output of the solid-state light emitting elements based on a sensed occupancy level of a sensed area around the light fixture.

This invention separately provides a light fixture having an ambient light sensor, an occupancy light sensor and control system that adjusts a light output of the solid-state light emitting elements based on the sensed ambient light and on a sensed occupancy level of a sensed area around the light fixture.

This invention separately provides a light fixture having control system that adjusts a light output of the solid-state light emitting elements based on a load signal indicative of an overall electric load of an area or structure in which the light fixture is located in.

Unlike fluorescent or HID lamps that have minimal options for varying light output, solid-state lamps, such as LED lamps, are completely adjustable in their output allowing for a near perfect match for any lighting scenario. The number of solid-state lamps used for each fixture will be based on desired illumination levels for a particular application. Highly polished reflectors can be used to improve fixture performance as well as to help dissipate heat.

In various exemplary embodiments, the light fixture body can be constructed of a high strength fiberglass. A high-strength polycarbonate diffuser lens, continuous-poured neoprene gasket and cam-action latch system can be used to cover and seal the light fixture assembly. The fixture will have a water resistant IP rating of at least 65, allowing protection from entry of dust, bugs, rain and low pressure power washing. The incoming electrical line will also be sealed. The fixture can be surface, chain, pendant or continuous row mounted.

One or more sensor packages can be mounted to the outside and/or inside of the light fixture body. The one or more sensor packages can include an ambient light sensor, an occupancy sensor, a load sensor or any other desired sensor whose output can be used to controllably modify the output or activation state of the solid-state lamps. A control system, which can be included in the one or more sensor packages or as a separate device, inputs the output signals from the one or more sensors and modifies the light output, and/or turns on or off, the solid-state lamps. The control system can also receive a control signal from a central location that monitors a total peak energy use by the building or location in which the light fixture body is located. In response to this signal, the control system can modify the light output, and/or turn on or off, the solid-state lamps when the overall energy use rises too high or falls back down from a peak energy use period.

In various exemplary embodiments, the LED system is under-driven to allow for age compensation. Under-driving the LEDs will increase their life and reduce energy usage. That is, by under-driving the LEDs, as the LEDs age and lose output later in their life, the control system will automatically sense that loss of output and increase the driving current, and thus the light output, accordingly, which will result in consistent light levels throughout the life of the product. With the LEDs normally under-driven, that leaves extra room to increase the output later in the life of the product without having to over-drive the LEDs.

In various other exemplary embodiments, a light fixture conversion kit includes multiple solid-state light emitting elements, such as LED elements, arranged into one or more solid state lamps, such as LED lamps, that are used in place of conventional light sources, such as standard T5, T8 or T12 fluorescent tubes within the housing of a conventional fluorescent light fixture. The conversion kit can include a reflector with one or more rows of LED lamps mounted on a back side of the reflector. Each LED lamp includes a plurality of LED elements that are mounted on a heat sink. The LED elements protrude through the reflector to the polished or reflective side of the reflector. The number of LED lamps can depend on the dimensions and number of lamps present in the light fixture that the conversion kit is being used to replace. The number of LED lamps can vary widely, allowing for flexibility in replacing all types of fluorescent or HID lighting. The conversion kit may additionally have additional elements that replace the existing pan, pins and/or ballasts of the fluorescent fixture.

In various exemplary embodiments, the housing can be modified so that one or more sensor packages can be mounted to the outside of the housing and/or to the inside of the housing. The one or more sensor packages can include an ambient light sensor, an occupancy sensor, a load sensor or any other desired sensor whose output can be used to controllably modify the output or activation state of the solid-state lamps. A control system, which can be included in the one or more sensor packages or as a separate device, inputs the output signals from the one or more sensors and/or remote control signals and modifies the light output, and/or turns on or off, the solid-state lamps.

In various exemplary embodiments, installing the conversion kit is simple and easy, requiring only basic hand tools. This process involves removing the existing lamps, ballast cover and socket brackets of a fluorescent lamp fixture to be retrofitted. New spring clips and chains are then installed with the supplied self-drilling screws. Next, the conversion LED pans are connected to the socket brackets with supplied ¼ turn fasteners. Finally, the LED pan is wired and fastened to the fixture body with supplied chains.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

DETAILED DESCRIPTION OF EXEMPLARY EMBODIMENTS

A solid-state light fixture includes multiple LED elements or other solid-state light emitting elements, in place of conventional light sources such as fluorescent, incandescent or high intensity discharge, (HID). For ease of description, the following detailed description of the following exemplary embodiments will refer primarily to LED lamps and elements. However, it should be understood that the phrases LED lamps and LED elements is intended to encompass any other known or later developed solid-state light emitting elements that can be appropriately used as disclosed herein.

The number of LED lamps used for each fixture will be based on what required levels exist for each application. Unlike fluorescent or HID that have minimal options for varying light output, the LED lamps are completely adjustable in their output allowing for a near perfect match for any lighting scenario. Highly polished reflectors are used to improve fixture performance as well as to dissipate heat.

Figure 1:
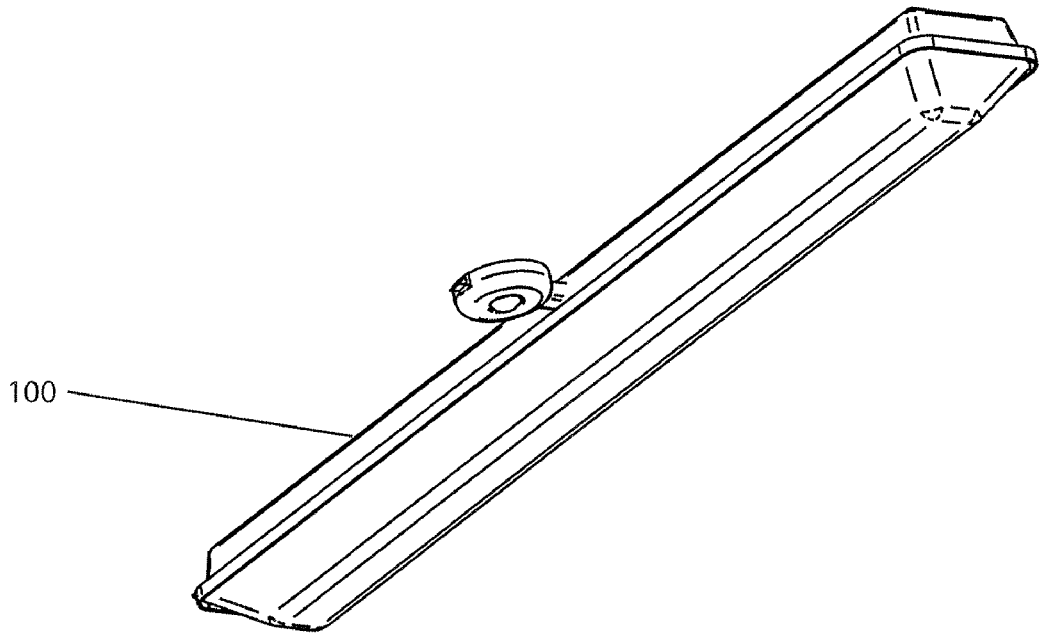
FIG. 1 is a first perspective view of a first exemplary embodiment of a solid-state lighting fixture according to this invention.
Figure 2:
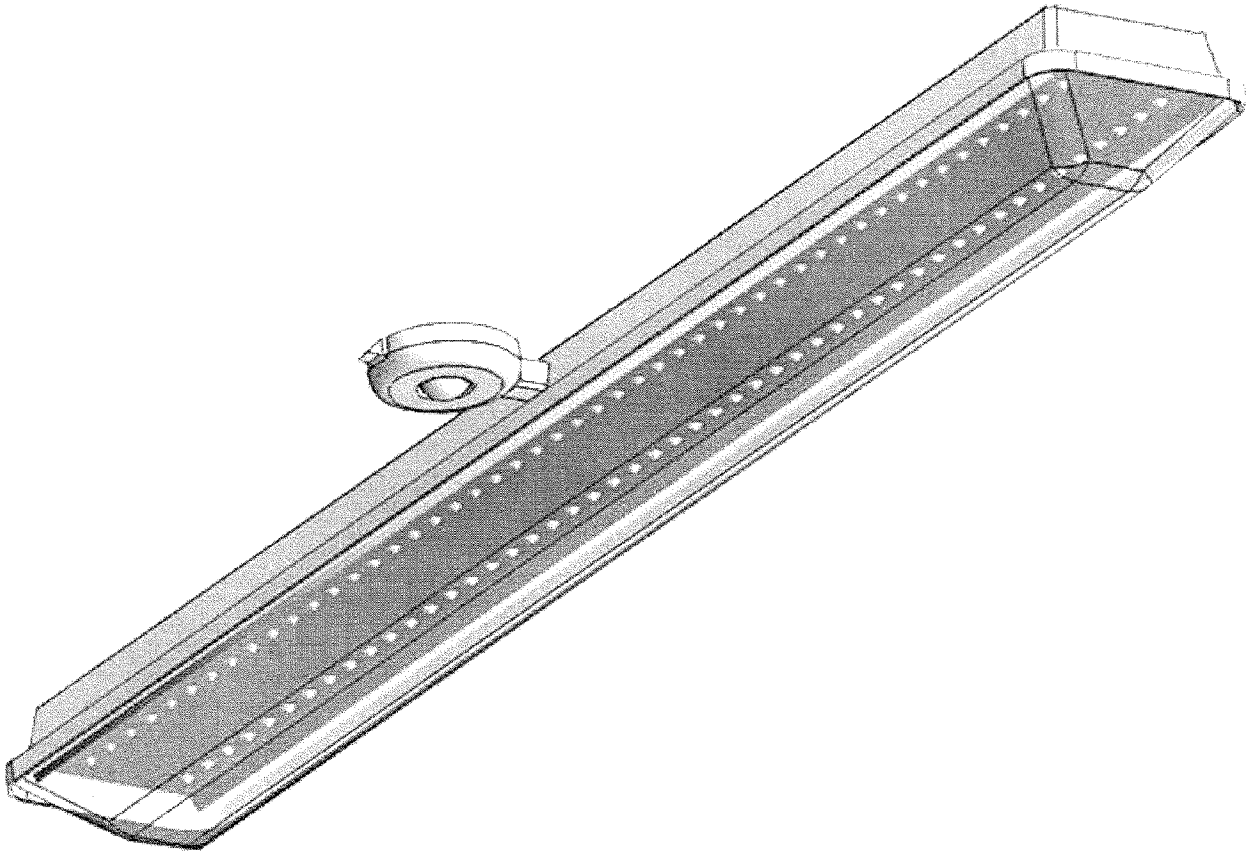
FIG. 2 is a second perspective view of the first exemplary embodiment of a solid-state lighting fixture according to this invention, with a transparent cover.
Figure 3:
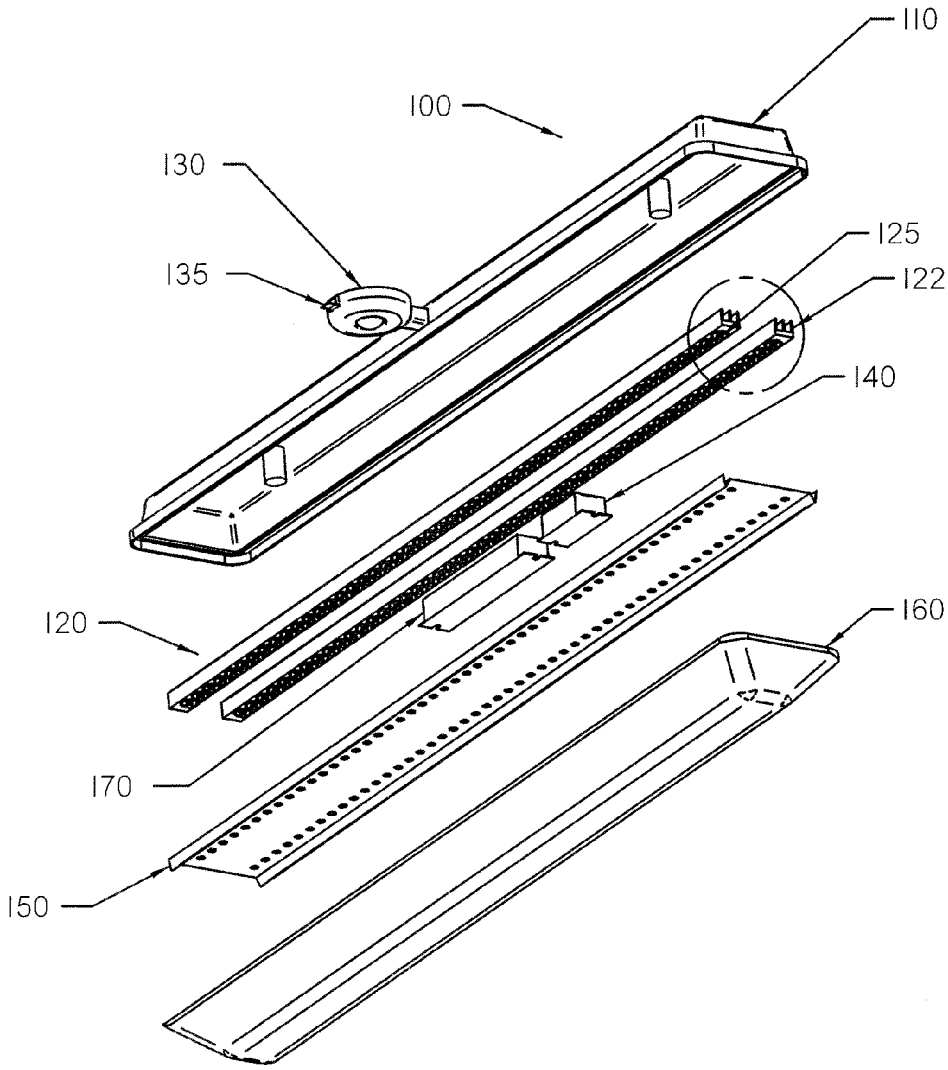
FIG. 3 is an exploded perspective view of the first exemplary embodiment of a solid-state lighting fixture according to this invention, showing the elements of the solid state lighting fixture, including a first exemplary embodiment of a solid-state lamp and reflector assembly.

FIGS. 1 and 2 show two perspective views of a first exemplary embodiment of a solid-state lighting fixture 100 according to this invention. FIG. 3 shows an exploded perspective view of the solid-state lighting fixture and its constituent elements. In the exemplary embodiment shown in FIGS. 1-3, the solid-state lighting fixture 100 includes a light fixture body or housing 110, a pair of LED lamps 120 each comprising a heat sink 122 and a plurality of LED packages 125 mounted on the heat sink 122, a reflector 150 and a diffuser 160. A power supply 170 and a load-shedding receiver 140 are mounted to an inside surface of the housing 110 above the LED lamps 120 and the reflector 150, while a sensor package, including an occupancy sensor 130 and a daylight sensor 135, is mounted to the outside of the housing 110.

In various exemplary embodiments, the light fixture body or housing 110 is constructed of a high strength fiberglass. In various exemplary embodiments, the diffuser 160, which can be implemented as a high-strength polycarbonate diffuser lens, a continuous-poured neoprene gasket and a cam-action latch system can be used to cover and seal the solid-state light fixture. This solid-state light fixture 100 will have a water resistant IP rating of at least 65, allowing protection from entry of dust, bugs, rain and low pressure power washing. In such exemplary embodiments, the incoming electrical line will also be sealed. It should be appreciated that the solid-state light fixture 100 can be surface, chain, pendant or continuous row mounted (lens down only).

Figure 4:
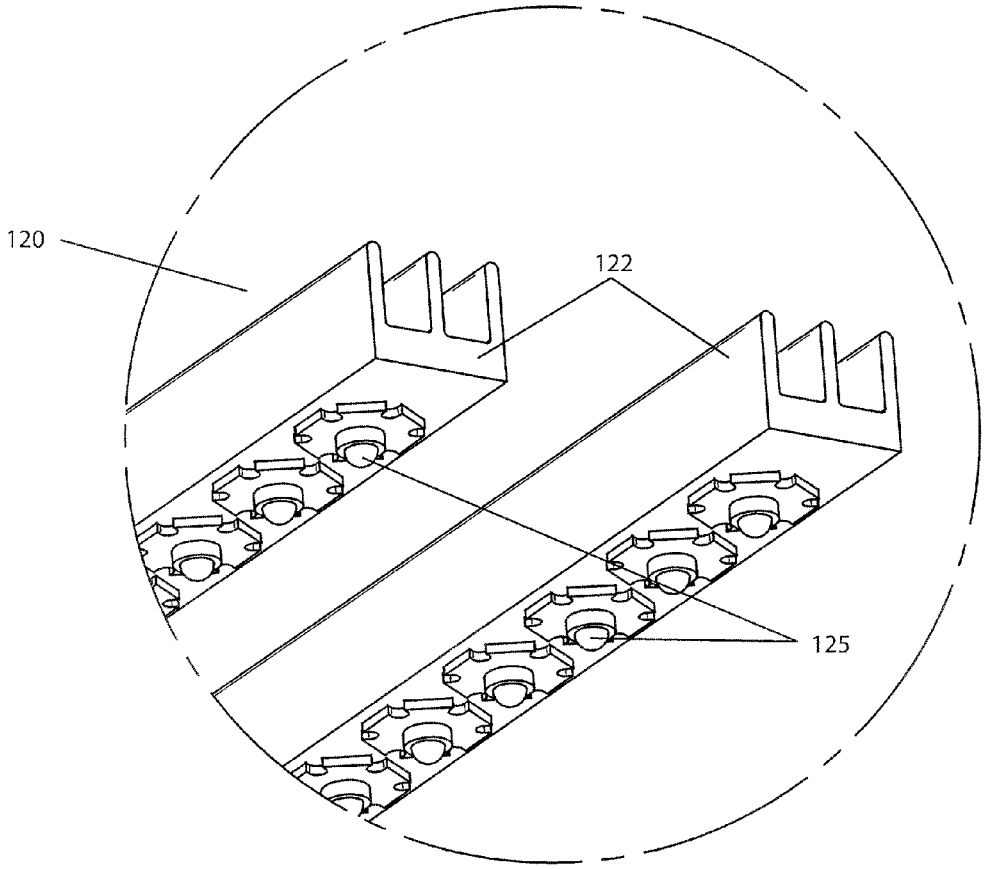
FIG. 4 is a perspective view showing in greater detail a first exemplary embodiment of a solid-state lamp according to this invention.

FIG. 4 shows a first exemplary embodiment of the LED lamps 120 in greater detail. As shown in FIG. 4, a plurality of LED packages 125 are mounted along a bottom surface of a heat sink 122, with the LED elements 125 themselves extending away from the bottom surface of the heat sink 122. The heat sink 122 has one or more heat dissipating fins extending from its top surface. Typically, the heat sink 122 will have a plurality of holes formed in it that allow the LED packages 125 to be mounted to the heat sink 122 and that allow the LED packages 125 to be connected to the power supply 170.

Figure 8:
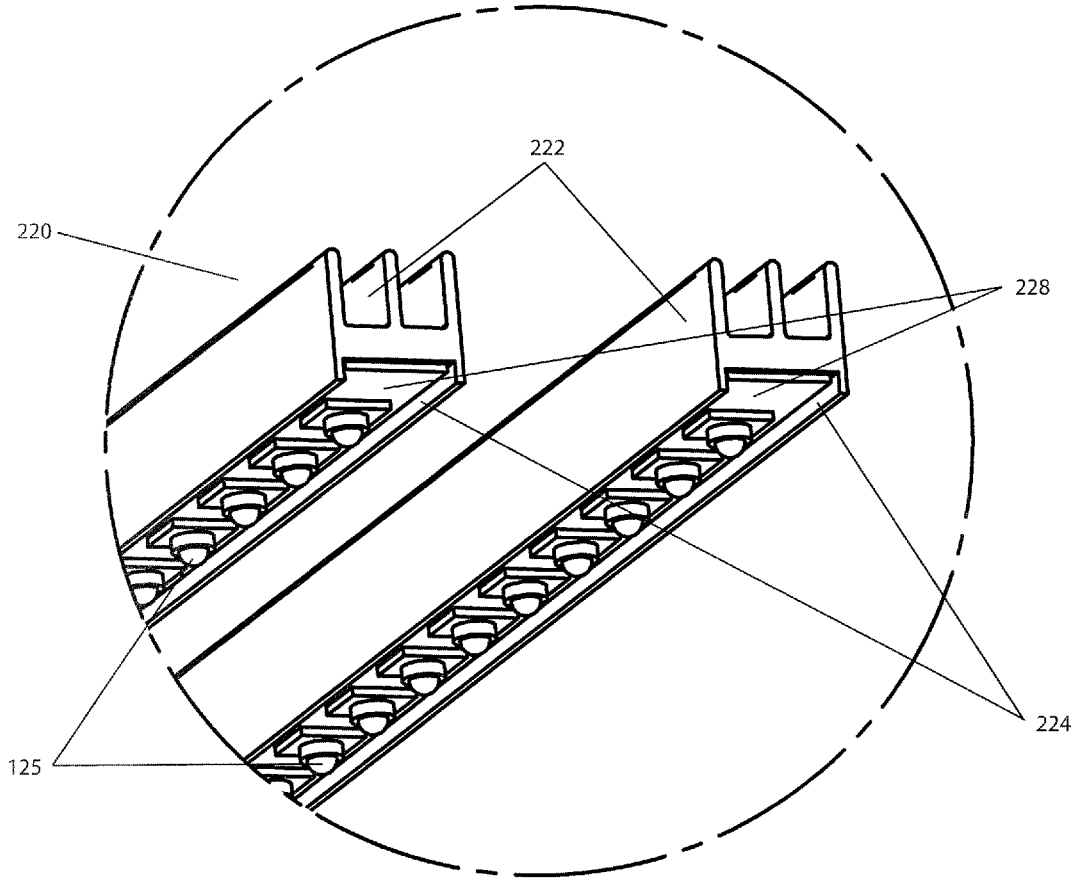
FIG. 8 is a perspective view showing in greater detail a second exemplary embodiment of a solid-state lamp according to this invention.

FIG. 8 shows a second exemplary embodiment of LED lamps 220 in greater detail. As shown in FIG. 8, in various other exemplary embodiments, the LED elements 125 of the LED lamps 220 are mounted on an electronic board 228, such as, for example, a printed circuit board, to form a single LED assembly. This allows for all of the LED elements 125 mounted on the board 228 to be installed into and to be easily removed from a channel 224 formed in a heat sink 222 as a single unit. The channel 224 allows the board 228 with the LED elements 125 to be mounted directly to the heat sink 222 for easy installation and removal. To allow the electrical connection to be as easily installed and removed, the two halves of a quick-connect electrical connector can be provided in the wires connecting the board 228 to the power supply 170.

In the exemplary embodiment shown in FIG. 3, the reflector 150 is a generally flat member. However, in various other exemplary embodiments, the reflector 150 can be curved or cupped to improve the fixture efficiency. In this exemplary embodiment, the reflector 150 has two sets of linearly-arranged holes. The LED lamps 120 are mounted to the back surface of the generally flat or directional reflector 150 such that the LED elements 125 extend through the holes and illuminate a lighted side of the reflector 150. In various exemplary embodiments, the angle of the reflector is matched to the direction that the opposing rows of LEDs are facing. In such exemplary embodiments, the reflector 150 reflects the light from the LED elements 125 out of the fixture. The reflector 150 is then connected to the housing 110 using, for example, the two bosses that extend downwardly from the interior surface of the housing 110.

Figure 5:
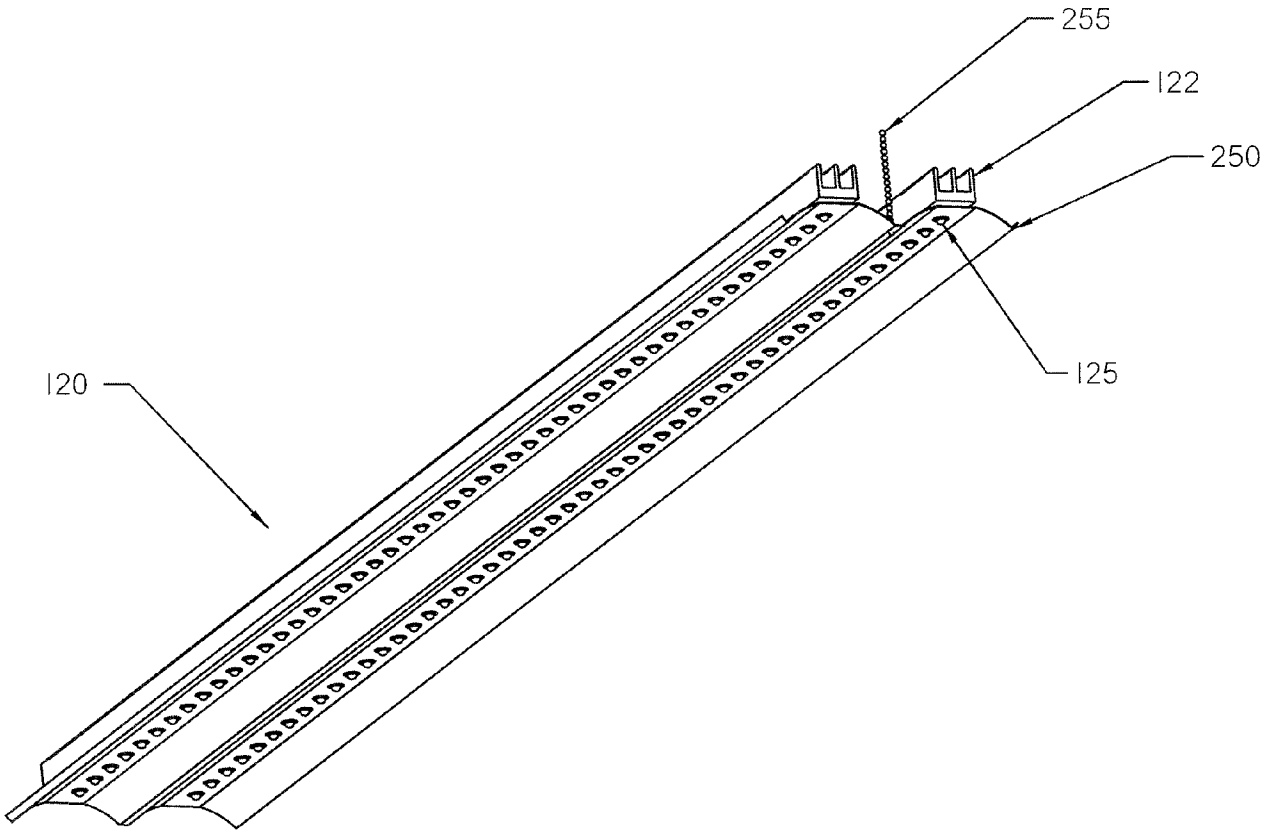
FIG. 5 is a perspective view showing a second exemplary embodiment of a solid-state lamp and reflector assembly according to this invention.

FIG. 5 shows a perspective view of a second exemplary LED lamp and reflector assembly. In the exemplary embodiment shown in FIG. 5, the reflector 250 comprises a pair of generally arcuate segments that are joined together along one edge. The generally arcuate segments can be formed, as shown in FIG. 5, by a flat central section and two arcuate wings. Each of the flat central sections is provided with a set of linearly arranged holes that the LED elements 125 of the LED lamps 120 extend through to illuminate the concave side of the generally arcuate segments. The light output from the LED diodes 125 may be directed or bounced off the reflective panel to create a more even and less directional output.

It should be appreciate that the exemplary embodiment of a solid-state light fixture 100 shown in FIGS. 1-5 has a variety of features. For example, it can be used to replace fluorescent two-foot, four-foot and/or eight-foot T12, T8, and T5 lighting fixtures and/or metal halide and high pressure sodium (HID) lighting fixtures. Due to its sealing features, it operates in wet environments and carries an IP rating of at least 65. Its versatile design allows for a wide range of applications. Due to using solid-state light emitting elements, each lamp has a lamp life of at least around 50,000 hours (and the life may extend to 100,000 or more hours), provides instant-on lighting, regardless of environmental temperatures, can provide color ranges from 2800K to 6000K, and works in almost any temperature. While the exemplary embodiment shown in FIGS. 1-5 has a sealed diffuser, this solid-state light fixture 100 can operate as an open fixture without the lens. As indicated above, the exemplary embodiment of a solid-state light fixture 100 shown in FIGS. 1-5 has a built in daylight sensor 135, a built in motion sensor 130, and an internal load shedding sensor 140 that communicates with the energy management system ("EMS").

Figure 6:
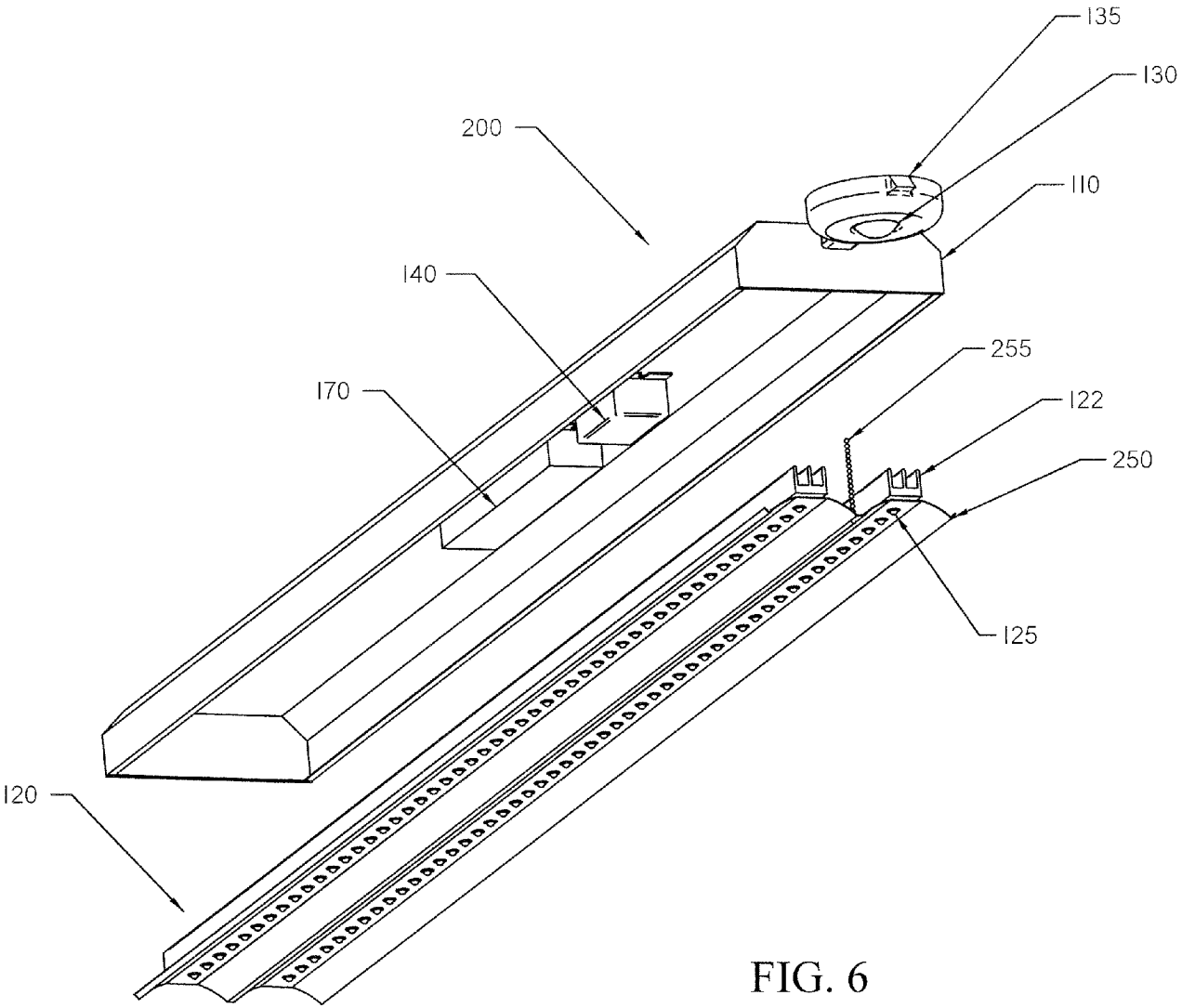
FIGS. 6 and 7 are perspective views of a first exemplary embodiment of a solid-state lamp conversion kit according to this invention.
Figure 7:
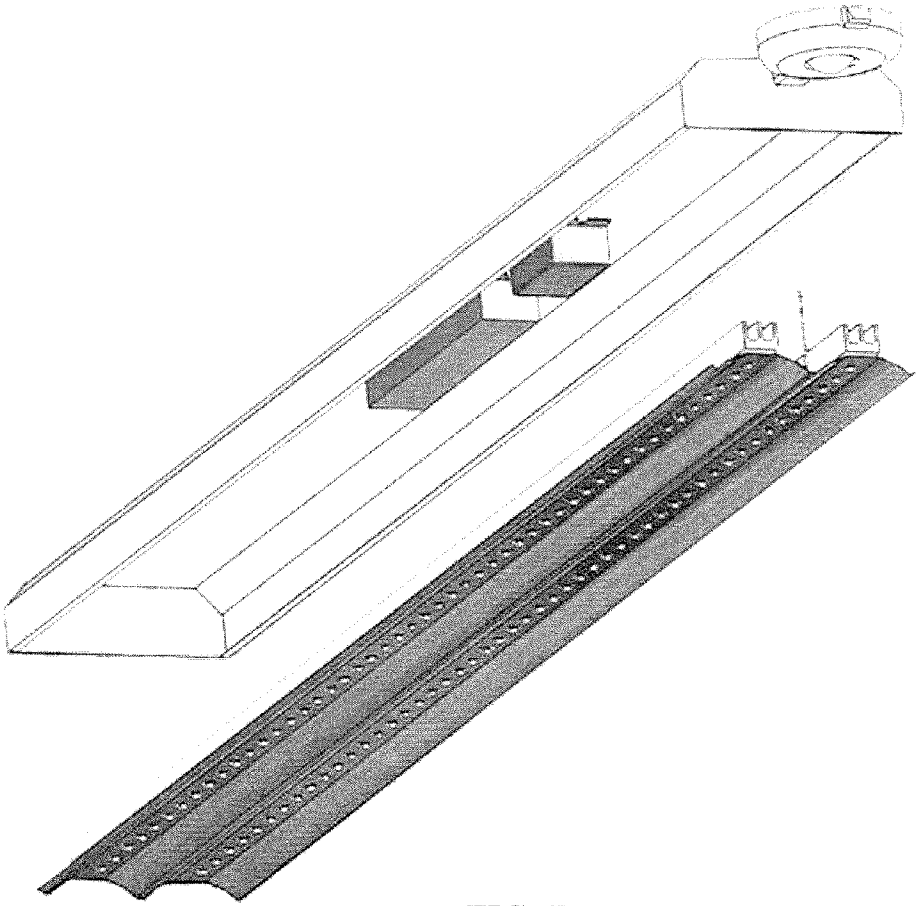

FIGS. 6 and 7 are perspective views of one exemplary embodiment of a solid-state lamp conversion kit 200 according to this invention. As shown in FIGS. 6 and 7, the light fixture conversion kit 200 includes multiple LED lamps 120, each comprising a plurality of LED elements 125, in place of conventional light sources such as standard fluorescent T5, T8 or T12 tubes. The number of LED lamps 120 used for each fixture will be based on what required levels exist for each application. Unlike fluorescent lamps that have minimal options for varying light output, the LED fixtures are completely adjustable in their output allowing for a near perfect match for any lighting scenario.

In various exemplary embodiments, the conversion kit includes an LED lamp and reflector assembly comprising a highly polished aluminum reflector 150 or 250 with rows of LED lamps 125 protruding through the polished side of the reflector 150 or 250. In the exemplary embodiment shown in FIGS. 6 and 7, the second exemplary LED lamp and reflector assembly shown in FIG. 5 is used as the LED lamp and reflector assembly. The number of LED lamps 120 will be dependent on the light fixture the conversion kit is being used to replace and can vary widely allowing for flexibility in replacing all types of fluorescent lighting. The conversion kit can also include structural and electric elements that replace the existing pan, pins and ballasts of the fluorescent fixture. The reflector 150 or 250 can be constructed from die formed code steel or white paint aluminum and is mounted to the underside of the existing fluorescent fixture housing. The reflector 150 or 250 can be attached to the existing fluorescent fixture housing die formed spring steel and chain for quick access to the power supply. Computer assisted design can be used to create a reflector shape that provides maximum light output, uniform light distribution and rigid strength for a given application. In various exemplary embodiments, the reflector pan has a minimum of 91% reflectivity (TR).

As outlined above with respect to FIGS. 3 and 5, in various other exemplary embodiments, the reflectors 150 and/or 250 used in a conversion kit 200 can be curved or cupped to improve the fixture efficiency, and/or the angle of the reflector can be matched to the direction that the opposing rows of LEDs are facing. In other exemplary embodiments, such reflectors 150 and/or 250 can have generally arcuate segments that are joined together along one edge. The light output from the LED packages 125 may be directed or bounced off the reflective panel to create a more even and less directional output.

In various exemplary embodiments, the housing can be modified so that one or more sensor packages can be mounted to the outside of the housing and/or to the inside of the housing. The one or more sensor packages can include an ambient light sensor 135, an occupancy sensor 130, a load sensor 140 or any other desired sensor whose output can be used to controllably modify the output or activation state of the solid-state lamps. A control system, which can be included in the one or more sensor packages or as a separate device, inputs the output signals from the one or more sensors and/or remote control signals and modifies the light output, and/or turns on or off, the solid-state lamps.

In various exemplary embodiments, installing the conversion kit is simple and easy, requiring only basic hand tools. This process involves removing the existing lamps, ballast cover and socket brackets of a fluorescent lamp fixture to be retrofit. New spring clips and chains are then installed with the supplied self-drilling screws. Next, the conversion LED pans are connected to the socket brackets with, for example, ¼ turn fasteners. Finally, the LED pan is wired and fastened to the fixture body with supplied chains 255.

It should be appreciated that the exemplary embodiment of a solid-state light conversion kit 200 shown in FIGS. 6 and 7 has a variety of features. For example, it can be used to replace fluorescent two-foot, four-foot and/or eight-foot T12, T8 and T5 fluorescent tubes in existing fluorescent lighting fixtures and/or metal halide and high pressure sodium, (HID) lamps in HID lighting fixtures. Its versatile design allows for a wide range of applications. Due to using solid-state light emitting elements, each lamp has, as indicated above, a lamp life of at least 50,000 hours, provides instant-on lighting, regardless of environmental temperatures, can provide color ranges from 2800K to 6000K, and works in almost any temperature. While the existing fluorescent light fixture shown in FIGS. 1-5 does not have a sealed diffuser, the LED lamp and reflector assembly, power supply, sensor package(s) and/or load-shedding receiver can be retrofit into a sealed fluorescent or HID lighting fixture. As indicated above, the exemplary embodiment of a solid-state light conversion kit 200 shown in FIGS. 6 and 7 has a built in daylight sensor, a built in motion sensor, and an internal load shedding sensor that communicates with the EMS system.

Control of the solid state lamps in the solid state lighting fixture can be provided in four ways: 1) occupancy sensing; 2) daylight sensing; 3) load sensing; and 4) a switch. In occupancy sensing, the fixture is controlled using a built-in occupancy sensor that will allow for complete preset variable lighting levels. Full level lighting can be used when necessary but as the areas surrounding the fixture become unoccupied, the light levels will either go off completely or be reduced to a pre-determined level.

In daylight sensing, as the daylight, or other ambient light, surrounding the solid state lighting fixture reaches a predetermined level, the daylight sensor will automatically reduce the output of the fixture by reducing the power supplied to the LED lamps. As more natural or ambient light is available, the fixture output will be reduced until, in some cases, all of the light in the space is provided by natural light and/or other light sources and the LED lamps are on stand-by until artificial or mechanical light is needed again.

In load sensing, many facilities come equipped with energy management systems (EMS) to help control equipment and avoid and lessen the affects and cost associated with high peak demand. In various exemplary embodiments, the fixture can be equipped with a sensor that will communicate with the EMS system, allowing the EMS to controllably and remotely dim the solid state lamps during times of peak load. This system may reduce or cut fixture loads in common or non-essential areas or may even reduce the main lighting depending on what levels currently exist and how low the various lighting levels are allowed to go.

Switching simply means that the solid-state lighting fixture can also be controlled by a simple switch as standard lighting sources are. An override system is in place that will allow for basic operation without use of the above mentioned controls.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A solid-state lighting fixture, comprising:

a housing having an inside surface and an outside surface;

a reflector assembly mounted in the housing, comprising:

at least one solid state lamp, each solid state lamp comprising:

a heat sink, and a plurality of solid state light emitting elements associated with the heat sink, wherein the plurality of solid state light emitting elements are in a defined arrangement;

a reflector having at least one set of holes associated with each of the at least one solid state lamp, each set of holes comprising a plurality of holes arranged in the defined arrangement such that the plurality of solid state light emitting elements extend through the holes, wherein each at least one solid state lamp is positioned adjacent to a back surface of the reflector and the plurality of solid state elements extend from the back surface of the reflector to illuminate a front surface of the reflector;

a power supply usable to power the plurality of solid state light emitting elements, the power supply positioned between the back surface of the reflector and the inside surface of the housing;

at least one sensor package, each sensor package including at least one sensor usable to sense an ambient environmental condition in an area associated with the solid state lighting fixture; and at least one load-shedding receiver mounted between the back surface of the reflector and the inside surface of the housing, each load-shedding receiver usable to reduce a supply current to at least one solid state lamp in response to a control signal.

2. The solid-state lighting fixture of claim 1, further comprising:

a gasket mounted to an open end of the inside surface of the housing; and a cover that is securable to the housing and that engages the gasket such that, when the cover engages the gasket and is secured to the housing, the solid-state lighting fixture has an IP rating of at least 65.

3. The solid-state lighting fixture of claim 1, wherein, for at least some of the at least one solid state lamp, the plurality of solid state light emitting elements of each such solid state lamp are mounted to the heat sink in the defined arrangement.

4. The solid-state lighting fixture of claim 1, wherein:

for at least some of the at least one solid state lamp, each such solid state lamp further comprises a board;

the plurality of solid state light emitting elements of each such solid state lamp are mounted to the board in the defined arrangement; and the board is thermally connected to the heat sink.

5. The solid-state lighting fixture of claim 4, wherein the board is a circuit board usable to electrically connect the plurality of solid state light emitting elements to the power supply.

6. The solid-state lighting fixture of claim 4, wherein the board is mechanically connected to the heat sink.

7. The solid-state lighting fixture of claim 1, wherein the at least one sensor usable to sense an ambient environmental condition in an area associated with the solid state lighting fixture comprises at least one of an occupancy sensor and an ambient light sensor.

8. The solid-state lighting fixture of claim 1, wherein at least one sensor of the sensor package is mounted to an outside surface of the housing.

9. The solid-state lighting fixture of claim 1, wherein at least one sensor of the sensor package is positioned inside the housing.

10. A solid-state conversion kit usable to convert a non-solid state lighting fixture to a solid state lighting fixture, the non-solid state lighting fixture having a housing having an inside surface and an outside surface, the solid-state conversion kit comprising:

a reflector assembly mountable in the housing, comprising:

at least one solid state lamp, each solid state lamp comprising:

a heat sink, and a plurality of solid state light emitting elements associated with the heat sink, wherein the plurality of solid state light emitting elements are in a defined arrangement;

a reflector having at least one set of holes associated with each of the at least one solid state lamp, each set of holes comprising a plurality of holes arranged in the defined arrangement such that the plurality of solid state light emitting elements extend through the holes, wherein each at least one solid state lamp is positioned adjacent to a back surface of the reflector and the plurality of solid state elements extend from the back surface of the reflector to illuminate a front surface of the reflector;

a power supply usable to power the plurality of solids state light emitting elements, the power supply mountable between the back surface of the reflector and the inside surface of the housing;

at least one sensor package, each sensor package including at least one sensor usable to sense an ambient environmental condition in an area associated with the solid state lighting fixture; and at least one load-shedding receiver mounted between the back surface of the reflector and the inside surface of the housing, each load-shedding receiver usable to reduce a supply current to at least one solid state lamp in response to a control signal.

11. The solid-state lighting fixture of claim 10, wherein, for at least some of the at least one solid state lamp, the plurality of solid state light emitting elements of each such solid state lamp are mounted to the heat sink in the defined arrangement.

12. The solid-state lighting fixture of claim 10, wherein:

for at least some of the at least one solid state lamp, each such solid state lamp further comprises a board;

the plurality of solid state light emitting elements of each such solid state lamp are mounted to the board in the defined arrangement; and the board is thermally connected to the heat sink.

13. The solid-state lighting fixture of claim 12, wherein the board is a circuit board usable to electrically connect the plurality of solid state light emitting elements to the power supply.

14. The solid-state lighting fixture of claim 12, wherein the board is mechanically connected to the heat sink.

15. The solid-state lighting fixture of claim 10, wherein the at least one sensor usable to sense an ambient environmental condition in an area associated with the solid state lighting fixture comprises at least one of an occupancy sensor and an ambient light sensor.

16. The solid-state lighting fixture of claim 10, wherein at least one sensor of the sensor package is mounted to an outside surface of the housing.

17. The solid-state lighting fixture of claim 10, wherein at least one sensor of the sensor package is positioned inside the housing.

18. A solid-state lighting fixture, comprising:

a housing having an inside surface and an outside surface;

a reflector assembly mounted in the housing, comprising:

at least one solid state lamp, each solid state lamp comprising:

a heat sink, and a plurality of solid state light emitting elements associated with the heat sink, wherein the plurality of solid state light emitting elements are in a defined arrangement;

a reflector having at least one set of holes associated with each of the at least one solid state lamp, each set of holes comprising a plurality of holes arranged in the defined arrangement such that the plurality of solid state light emitting elements extend through the holes, wherein each at least one solid state lamp is positioned adjacent to a back surface of the reflector and the plurality of solid state elements extend from the back surface of the reflector to illuminate a front surface of the reflector;

a power supply usable to power the plurality of solid state light emitting elements, the power supply positioned between the back surface of the reflector and the inside surface of the housing;

at least one sensor package, each sensor package including at least one sensor usable to sense an ambient environmental condition in an area associated with the solid state lighting fixture;

a gasket mounted to an open end of the inside surface of the housing; and a cover that is securable to the housing and that engages the gasket such that, when the cover engages the gasket and is secured to the housing, the solid-state lighting fixture has a water resistant IP rating of at least 65.

* * * * *